US010355397B2

(12) United States Patent
Hirota

(10) Patent No.: US 10,355,397 B2
(45) Date of Patent: Jul. 16, 2019

(54) RUBBER PLUG AND WATERPROOF CONNECTOR

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/049,868

(22) Filed: Jul. 31, 2018

(65) Prior Publication Data

US 2019/0067869 A1 Feb. 28, 2019

(30) Foreign Application Priority Data

Aug. 23, 2017 (JP) ..... 2017-155945

(51) Int. Cl.
*H01R 13/52* (2006.01)
*H01R 13/502* (2006.01)
*H01R 13/422* (2006.01)

(52) U.S. Cl.
CPC ..... *H01R 13/5208* (2013.01); *H01R 13/4223* (2013.01); *H01R 13/5025* (2013.01); *H01R 13/5216* (2013.01)

(58) Field of Classification Search
CPC ..... H01R 13/5208; H01R 13/4223; H01R 13/5025; H01R 13/5216
USPC ..... 439/588
See application file for complete search history.

(56) References Cited

U.S. PATENT DOCUMENTS 6,786,768 B2 * 9/2004 Murakami ..... H01R 13/4365 439/271
6,935,893 B1 * 8/2005 Flowers ..... H01R 13/4365 439/595
7,253,638 B2 * 8/2007 Nakamura ..... H01R 13/4534 324/538
7,303,437 B2 * 12/2007 Nishide ..... H01R 13/447 439/595
8,187,042 B2 * 5/2012 Kimura ..... H01R 13/52 439/271
8,215,987 B2 * 7/2012 Yoshioka ..... H01R 13/4362 439/587
9,106,000 B2 * 8/2015 Mizutani ..... H01R 13/4365
9,153,899 B2 * 10/2015 Morello ..... H01R 13/521
9,711,915 B2 * 7/2017 Hiramatsu ..... H01R 13/46
(Continued)

FOREIGN PATENT DOCUMENTS

JP 2016-100295 5/2016

*Primary Examiner* — Alexander Gilman
(74) *Attorney, Agent, or Firm* — Gerald E. Hespos; Michael J. Porco; Matthew T. Hespos

(57) ABSTRACT

A rubber plug (10) includes a mat-like rubber plug body (12) with sealing holes (11) for receiving a wire with terminal (95) in a liquid-tight manner. Rounded corner parts (13) protruding out on the rubber plug body (12). Outer peripheral lips (18) are provided circumferentially on an outer periphery of the rubber plug body (12) and inner peripheral lips (19) are provided circumferentially on inner peripheries of the sealing holes (11). Lightening portions (21) are provided for the outer peripheral lips (18) in base end parts of the outer peripheral lips (18) and parts facing the inner peripheral lips (19) of the sealing holes (11) near the corner parts (13) of the rubber plug body (12). The lightening portions (21) are recessed more inward than regions (22) adjacent in a circumferential direction.

5 Claims, 5 Drawing Sheets

(56) References Cited

U.S. PATENT DOCUMENTS

| | | | | |
|---|---|---|---|---|
| 9,923,298 | B2 * | 3/2018 | Hashimoto | H01R 13/516 |
| 9,960,547 | B1 * | 5/2018 | Hetrick | H01R 13/745 |
| 10,164,371 | B2 * | 12/2018 | Hara | H01R 13/4362 |
| 2002/0086580 | A1 * | 7/2002 | Kurimoto | H01R 13/4364<br>439/595 |

* cited by examiner

RUBBER PLUG AND WATERPROOF CONNECTOR

BACKGROUND

Field of the Invention

The invention relates to a rubber plug and a waterproof connector.

Related Art

Japanese Unexamined Patent Publication No. 2016-100295 discloses a rubber plug serving as a resilient sealing member including a plate-like body formed of a resilient material. The body includes a plurality of sealing holes into each of which a wire with terminal is inserted in a liquid-tight manner. The body has a substantially rectangular shape when viewed from the front and has four corners protruding out. This resilient sealing member is accommodated into a rear accommodation chamber of a connector housing and is held in a liquid-tight manner.

Each sealing hole is pushed and expanded by the wire with terminal to receive a deformation force in a diameter expansion direction. A larger deformation force in the diameter expansion direction is applied to the sealing holes on an end side of the body. Further, each sealing hole receives a deformation force in a diameter reduction direction by the inner surface of the rear accommodation chamber. The corners of the body are thicker than surroundings because of protruding out. Thus, a large deformation force in the diameter reduction direction acts on the sealing hole near the corner by a resilience force from the inner rear accommodation chamber. The deformation force in the diameter expansion direction may cause this sealing hole to distort and deform. Thus, the inner surface of the sealing hole near the corner easily is damaged by a terminal passing through the sealing hole and a wire may be inserted in a bent state.

The invention was completed on the basis of the above situation and aims to provide a rubber plug and a waterproof connector capable of ensuring good sealing of corner parts.

SUMMARY

The invention is directed to a rubber plug with a mat-like rubber plug body including sealing holes, and a wire with terminal is inserted into each sealing hole in a liquid-tight manner. The rubber plug body includes a corner part protruding out and has an outer peripheral lip circumferentially provided on an outer periphery. An inner peripheral lip is provided circumferentially on an inner periphery of each sealing hole. A lightening portion is provided for the outer peripheral lip in a base end part of the outer peripheral lip and in a part facing the inner peripheral lip of the sealing hole near the corner part on the corner part side on the outer periphery of the rubber plug body. The lightening portion is recessed more inward than regions adjacent in a circumferential direction.

The lightening portion reduces the resilient force acting on the corner part of the rubber plug body. Thus, the sealing hole near the corner part need not be deformed a large amount, thereby preventing the inner surface of the sealing hole from being damaged by the terminal, and the wire is not inserted into the sealing hole in a bent state. The lightening portion in the base end part of the outer peripheral lip does not reduce close contact of the outer peripheral lip, and a recessed amount of the lightening portion can be adjusted according to an inward projecting amount of the inner peripheral lip by providing the lightening portion in the part facing the inner peripheral lip of the sealing hole on the corner part side. Therefore, good sealing of the corner part of the rubber plug body can be ensured.

The rubber plug body may have sealing holes with different hole diameters, and the sealing hole near the corner may be a large-diameter sealing hole with a larger diameter than the other sealing holes. The large-diameter sealing hole near the corner is deformed resiliently a large amount when the wire with terminal is inserted, and a predetermined sealing is ensured by allowing a resilient force to escape at the lightening portion.

The rubber plug body may be substantially rectangular with four corners in a front view, and the lightening portion may include a deepest part near the corner that is recessed most deeply from a vertex of the corner toward a center of the sealing hole. Conventionally, corners of a rubber plug body tend to be thickest and have a large resilient force on vertex parts. However, according to the above configuration, the deepest part of the lightening portion is at a position corresponding to the vertex. Thus, the resilient force on the vertex part can be reduced significantly so that a predetermined sealing can be ensured reliably.

The invention also may be directed to a waterproof connector with a connector housing having an accommodation recess for accommodating the above-described rubber plug. The outer peripheral lip is held resiliently in close contact with an inner periphery of the accommodation recess. Good sealing between the connector housing and the rubber plug is ensured by resiliently holding the outer peripheral lip in close contact with the inner periphery of the accommodation recess.

DETAILED DESCRIPTION

Figure 1:
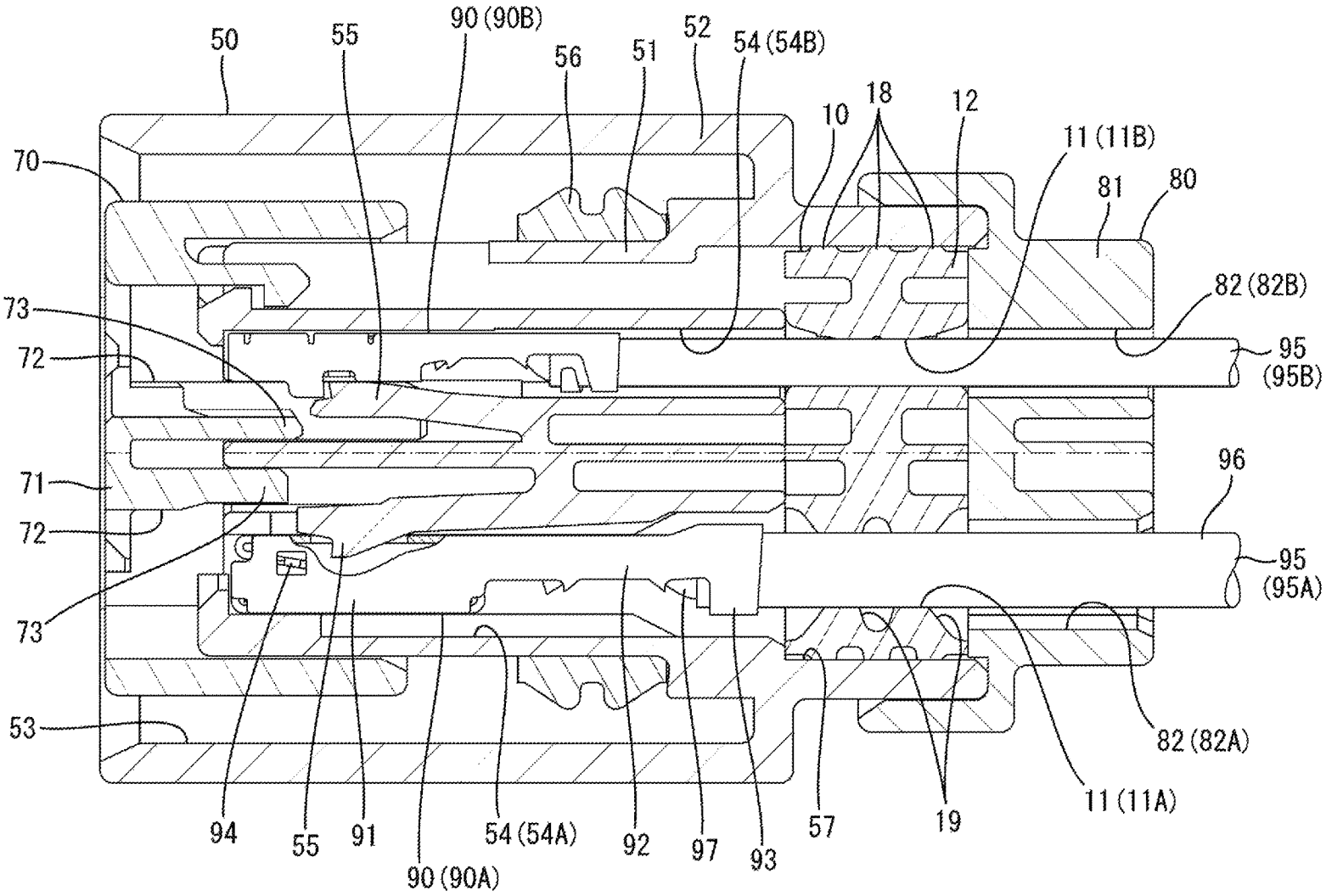
FIG. 1 is a side view in section at positions corresponding to a small-diameter sealing hole and a large-diameter sealing hole, showing a waterproof connector according to one embodiment of the invention.

An embodiment of the invention is described on the basis of FIGS. 1 to 5. A waterproof connector of this embodiment includes a connector housing 50, terminal fittings 90, a rubber plug 10, a rear holder 80 and a front retainer 70, as shown in FIG. 1.

The connector housing 50 is made of synthetic resin and includes, as shown in FIG. 1, a housing body 51 substantially in the form of a rectangular block and a rectangular fitting tube 52 surrounds the outer periphery of the housing body 51. A space between the housing body 51 and the fitting tube 52 is open forward and defines a fitting portion 53 into which an unillustrated mating connector housing is finable.

Cavities 54 penetrate the housing body 51 in a front-rear direction. The cavities 54 large-diameter cavities 54A having a large hole diameter and small-diameter cavities 54B having a small hole diameter. Although not shown in detail, the small-diameter cavities 54B are aligned and arranged laterally in upper and lower stages in the housing body 51, and the large-diameter cavities 54A are arranged on both sides of the small-diameter cavities 54B and on four corner parts of the housing body 51.

A locking lance 55 is cantilevered forward on the inner surface of each cavity 54. The terminal fittings 90 are inserted into the respective cavities 54 from behind and are locked by the locking lance 55 in the respective cavity 54 to achieve primary locking in the connector housing 50.

The front retainer 70 is made of synthetic resin and defines cap mounted on the housing body 51 from the front, as shown in FIG. 1. This front retainer 70 includes a retainer body 71 in the form of a flat plate for covering the front surface of the housing body 51, and tab insertion holes 72 penetrate the retainer body 71 at positions communicating with the respective cavities 54. Tabs of unillustrated mating terminal fittings in the mating connector housing enter the cavities 54 through the tab insertion holes 72 and achieve electrical connection to the terminal fittings 90 in the cavities 54 when the connector housing 50 is connected to the mating connector housing. The front retainer 70 includes restricting pieces 73 at positions corresponding to the locking lances 55. The restricting pieces 73 enter deflection spaces for the locking lances 55 when the front retainer 70 is mounted properly on the housing body 51, thereby restricting deflection of the locking lances 55 and secondarily retaining the terminal fittings 90 in the connector housing 50.

A seal ring 56 is fit behind the front retainer 70 on the outer periphery of the housing body 51. The seal ring 56 is resiliently sandwiched between a receptacle part of the mating connector housing and the housing body 51, thereby sealing between the connector housings in a liquid-tight manner.

An accommodation recess 57 for the rubber plug 10 is open in the rear surface of the housing body 51. The back surface of the accommodation recess 57 extends vertically, and the rear ends of the respective cavities 54 open in this back surface. The rubber plug 10 is inserted into the accommodation recess 57 of the housing body 51 from behind.

The rear holder 80 is made of synthetic resin and, as shown in FIG. 1, is mounted on the housing body 51 from behind. The rear holder 80 includes a holder body 81 having a predetermined thickness for closing the rear end of the accommodation recess 57. The holder body 81 is mounted and fixed to the housing body 51 to retain the rubber plug 10 in the accommodation recess 57. Further, the holder body 81 is provided with through holes 82, including large-diameter through holes 82A corresponding to the large-diameter cavities 54A and small-diameter through holes 82B corresponding to the small-diameter cavities 54B. A wire 95 connected to the terminal fitting 90 is inserted loosely into each through hole 82.

The terminal fitting 90 is long and narrow in the front-rear direction and is formed such as by stamping a conductive metal plate into a predetermined shape and bending the stamped piece. As shown in FIG. 1, the terminal fittings 90 include large terminal fittings 90A to be inserted into the respective large cavities 54A and connected to end parts of wires 95A for high current and small terminal fittings 90B to be inserted into the respective small cavities 54B and connected to ends of wires 95B for low current.

Specifically, the terminal fitting 90 includes a rectangular tubular connecting portion 91, an open wire barrel 92 connected behind the connecting portion 91 and an open insulation barrel 93 connected behind the wire barrel portion 92. The wire barrel 92 is crimped and connected to a core 97 exposed by removing a coating 96 on an end part of the wire 95. The insulation barrel 93 is crimped and connected to the coating 96 on the end part of the wire 95. The connecting portion 91 can receive the tab of the mating terminal fitting and is connected electrically connected to the mating terminal fitting by the tab resiliently contacting a resilient contact piece 94 arranged inside the connecting portion 91. Further, the locking lance 55 is locked to the connecting portion 91.

Figure 2:
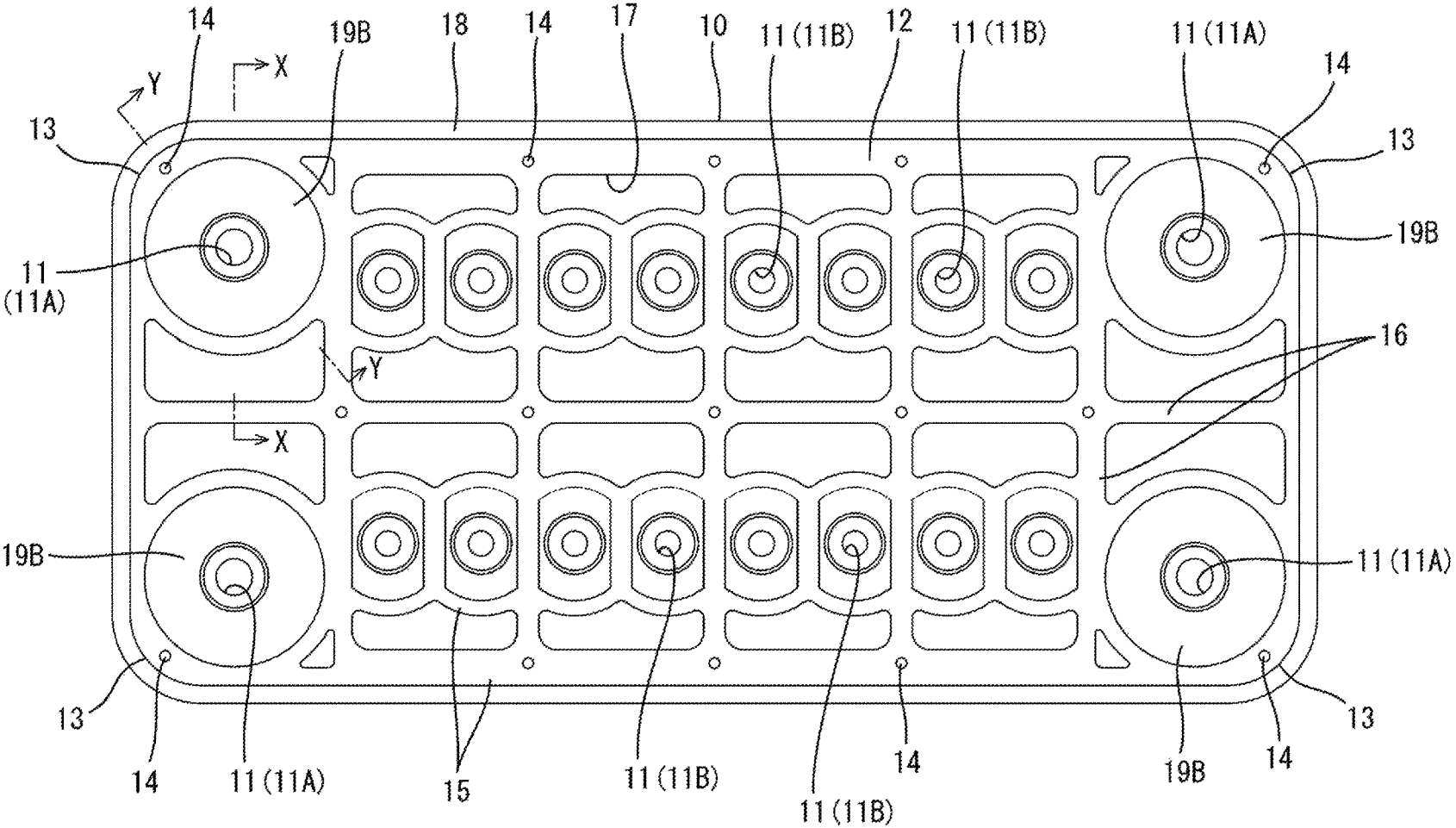
FIG. 2 is a front view of a rubber plug.

The rubber plug 10 is made of rubber, such as silicon rubber, and includes, as shown in FIG. 2, a mat-like rubber plug body 12 having sealing holes 11. The rubber plug body 12 has a laterally long substantially rectangular shape when viewed from the front and has four corner parts 13 rounded and protruding out at diagonal positions. Further, the rubber plug body 12 has a predetermined thickness in the front-rear direction and is arranged so that both front and rear surfaces extend along the vertical direction. This rubber plug 10 is shaped to be point-symmetrical in front and side views, and vertical and lateral orientations thereof need not be distinguished.

Small projections 14 are provided at intervals in the vertical and lateral directions on both front and rear surfaces of the rubber plug body 12. Each small projection 14 on the front surface of the rubber plug body 12 is held in close contact with the back surface of the accommodation recess 57 while being squeezed. Each small projection 14 on the rear surface of the rubber plug body 12 is held in close contact with the front surface of the holder body 81 while being squeezed.

Circling ribs 15 are provided on both front and rear surfaces of the rubber plug body 12 at positions bordering opening edges of the respective sealing holes 11 and also on the outer periphery of the rubber plug body 12. Additionally, lattice ribs 16 extend in the vertical and lateral directions between the respective sealing holes 11. Bottomed recesses 17 are provided between the circling ribs 15 and the lattice ribs 16. The recesses 17 have equal diameters in a depth direction and constitute thin parts of the rubber plug body 12. Note that the small projections 14 are arranged on intersections of the lattice ribs 16 and on the four corner parts 13.

Figure 3:
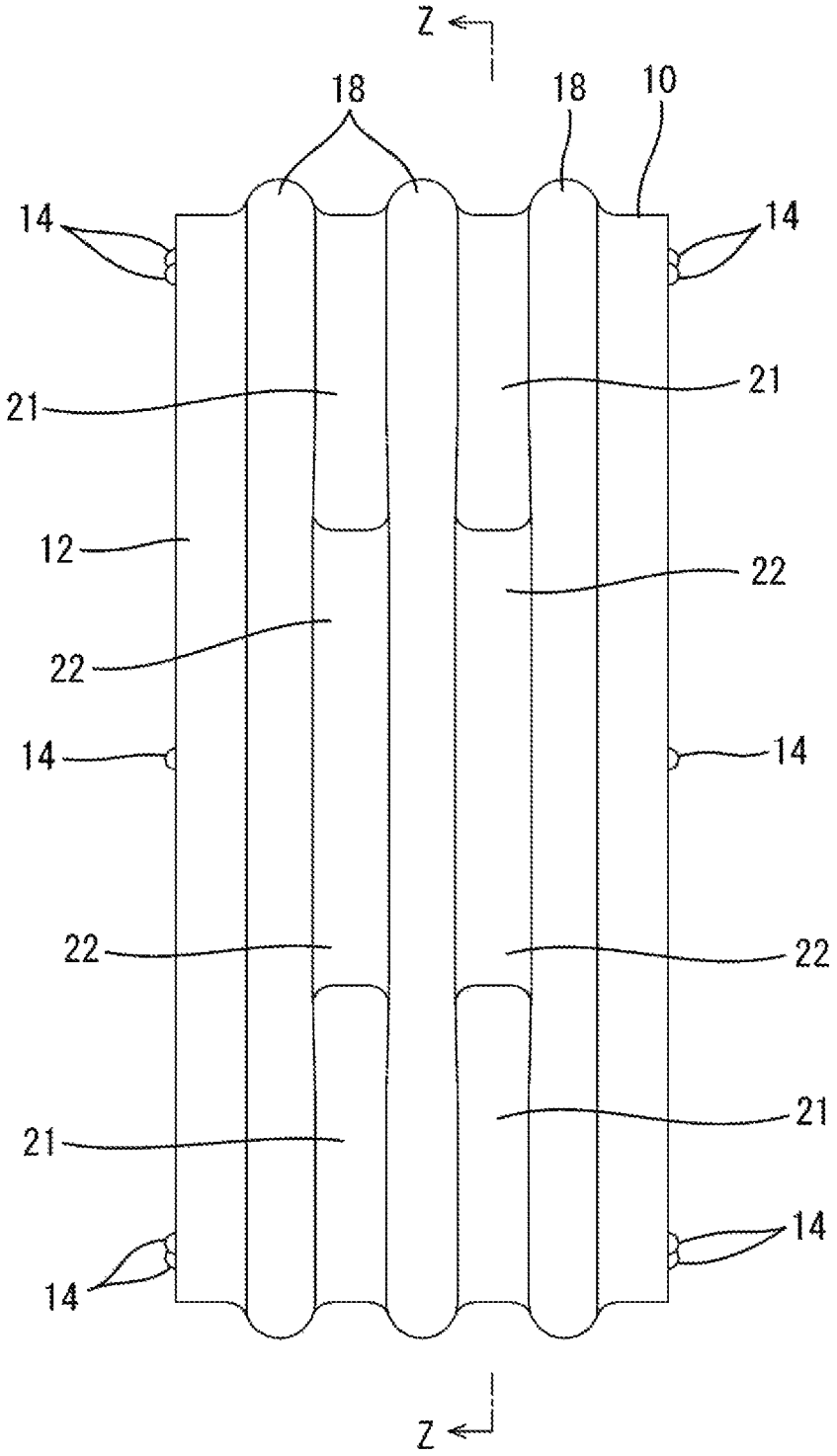
FIG. 3 is a side view of the rubber plug.
Figure 5:
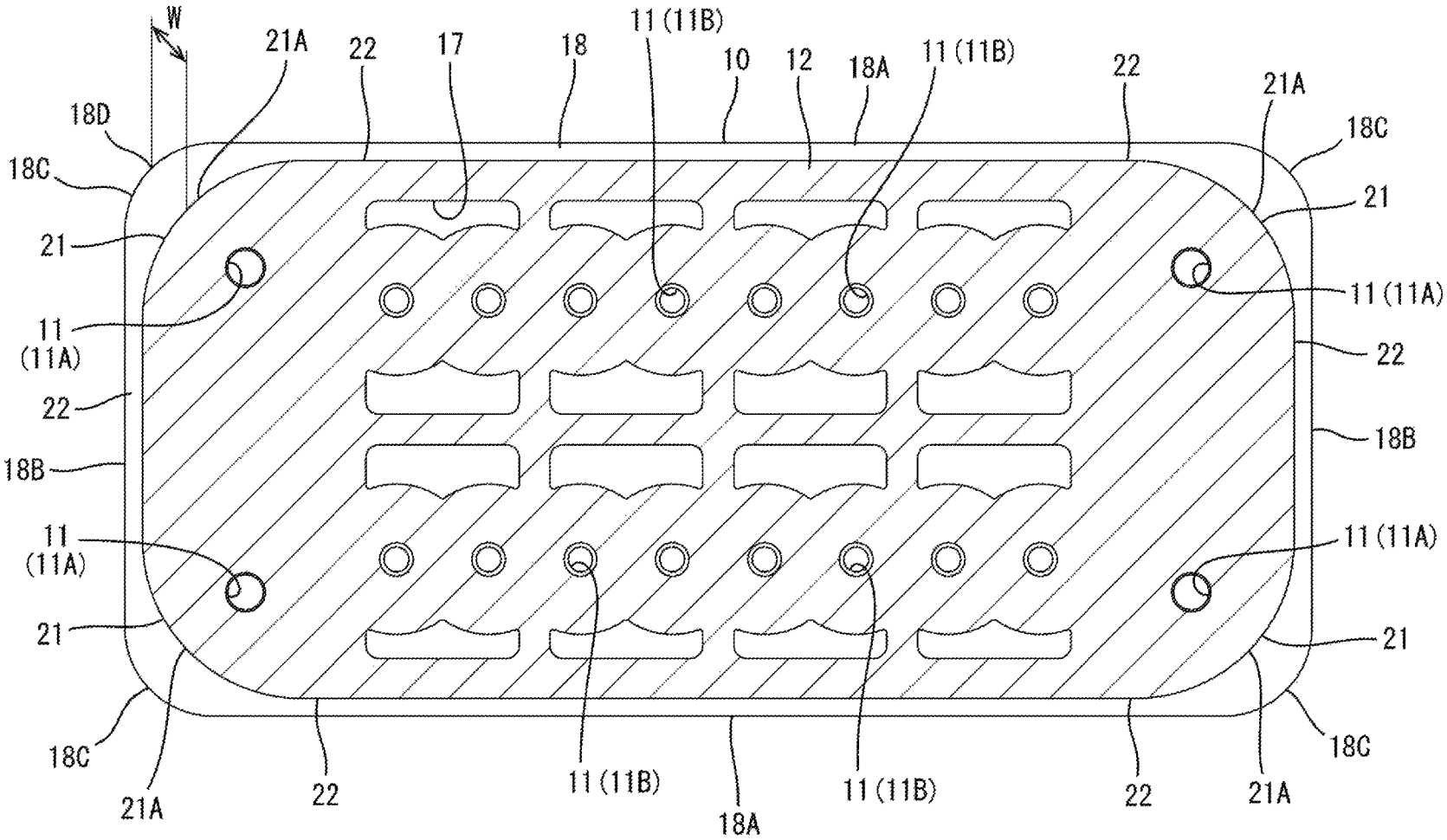
FIG. 5 is a section along Z-Z of FIG. 3.

As shown in FIG. 3, outer peripheral lips 18 project on the outer periphery of the rubber plug body 12 and are arranged in the front-rear direction. The outer peripheral lips 18 have arcuate cross-sectional shapes and extend circumferentially over the entire outer periphery of the rubber plug body 12. Additionally, the outer peripheral lips 18 have the same projecting dimension and are aligned with each other at the same height. As shown in FIG. 5, a top part of each outer peripheral lip 18 includes two long top parts 18A extending laterally along the upper and lower surfaces of the rubber plug body 12, two short top parts 18B extending vertically along the left and right surfaces of the rubber plug body 12 and arcuate curved top parts 18C between the long side top parts 18A and the short side top parts 18B on the four corner parts 13. Further, the curved top parts 18C of each outer peripheral lip 18 have vertices 18D at positions most distant from centers of sealing holes 11 (to be described later) located near the corresponding corner parts 13.

The sealing holes 11 include large-diameter sealing holes 11A corresponding to the respective large-diameter cavities 54A and small-diameter sealing holes 11B corresponding to the respective small-diameter cavities 54B. The small-diameter sealing holes 11B are aligned laterally in two stages in the rubber plug body 12, and the large-diameter sealing holes 11A are respectively on both sides across the respective small-diameter sealing holes 11B and near the four corner parts 13 of the rubber plug body 12. As shown in FIG. 2, the vertical lattice ribs 16 are arranged laterally to partition groups of the small-diameter sealing holes 11B composed of plural (two in the shown example) small-diameter sealing holes 11B and individually partition the large-diameter sealing holes 11A.

As shown in FIG. 4, plural (two in the shown example) inner peripheral lips 19 project on the inner periphery of each sealing hole 11 and are arranged in the front-rear direction. Each inner peripheral lip 19 has a chevron cross-sectional shape and is provided over the entire inner periphery of each sealing hole 11 to be continuous at the same projecting dimension and to align with each other at the same height.

Each inner peripheral lip 19 has a steep slope part 19A steeply inclined toward a central side of each sealing hole 11 in the front-rear direction, a gentle slope part 19B gently inclined toward a front or rear end side of each sealing hole 11 and an arcuate top surface part 19C between the steep slope part 19A and the gentle slope part 19B on a tip part in a projecting direction. The gentle slope part 19B of each inner peripheral lip 19 is expanded in diameter from the top surface part 19C toward the front or rear surface of the rubber plug body 12 and functions as a guide surface for guiding the terminal fitting 90.

The top surface part 19C of each inner peripheral lip 19 is arranged at a position overlapping with a valley between adjacent outer peripheral lips 18 and is substantially at the same position as a bottom surface of the recessed part 17 in the front-rear direction.

Lightening portions 21 are provided on the outer periphery of the rubber plug body 12 in a base end part corresponding to the valley between adjacent outer peripheral lips 18 and on the four corner parts 13. The lightening portions 21 are recessed more inward than adjacent regions 22 on both circumferential sides.

Figure 4A:
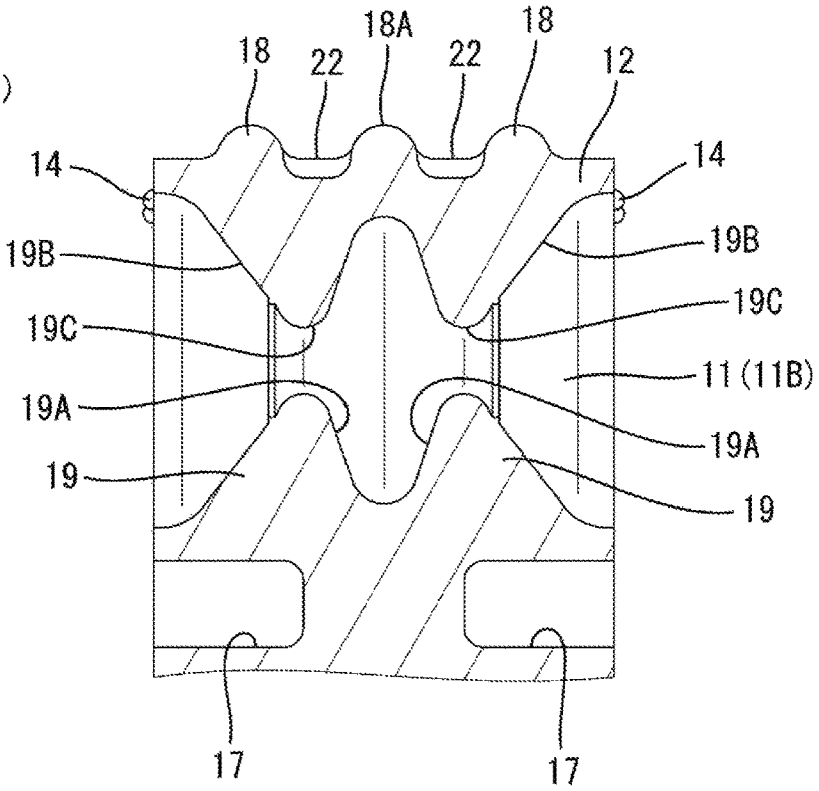
FIG. 4(A) is a section along X-X of FIG. 2.
Figure 4B:
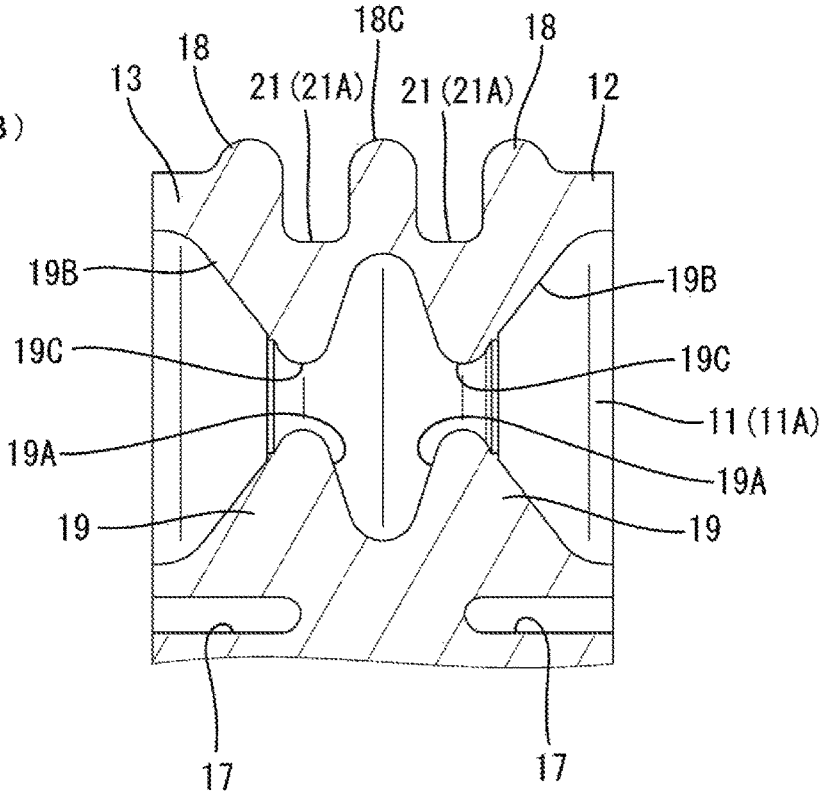
FIG. 4(B) is a section along Y-Y of FIG. 2.

As shown in FIGS. 4(A) and 4(B), a depth from the curved top part 18C of the outer peripheral lip 18 to the lightening portion 21 is larger than a depth from the long top part 18C or the short top part 18B of the outer peripheral lip 18 to the adjacent region 22. As shown in FIG. 5, each lightening portion 21 has an arcuate cross-sectional shape to gradually increase the depth from the curved top part 18C of the outer peripheral lip 18 from the both circumferential ends to a center, and a radius of curvature thereof is larger than that of the curved top part 18C of the outer peripheral lip 18. A circumferential center of each lightening portion 21 serves as a deepest part 21A deepest in a depth direction (direction of an arrow W of FIG. 5) from the vertex 18D of the outer peripheral lip 18 to a center of the large-diameter sealing hole 11A.

Each lightening portion 21 is arranged in correspondence with the inner peripheral lip 19 so as to overlap with the inner peripheral lip 19 of the corresponding large-diameter sealing hole 11. As shown in FIG. 4(B), the deepest part 21A of the lightening portion 21 is inwardly of an expanded opening end of the gentle slope 19B of each inner peripheral lip 19 with respect to a radial direction of each sealing hole 11, and the lightening portion 21 is recessed with a sufficient depth on the outer periphery of the corner part 13.

Next, functions and effects of the embodiment are described.

In assembling, the rubber plug 10 is inserted into the accommodation recess 57 of the connector housing 50 from behind and, subsequently, the rear holder 80 is mounted on a rear part of the connector housing 50. In this way, the large-diameter cavities 54A, the large-diameter sealing holes 11A and the large-diameter through holes 82A coaxially communicate in the front-rear direction, and the small-diameter cavities 54B, the small-diameter sealing holes 11B and the small-diameter through holes 82B similarly coaxially communicate in the front-rear direction (see FIG. 1).

The terminal fittings 90 then are inserted into the cavities 54 of the connector housing 50 from behind to be locked by the locking lances 55. At this time, the wire 95 connected to the terminal fitting 90 is inserted into the sealing hole 11 of the rubber plug 10 in a liquid-tight manner behind the cavity 54, loosely inserted into the through hole 82 of the rear holder 80 behind the sealing hole 11 and pulled out rearward from the rear holder 80.

As described above, the inner peripheral lips 19 of each sealing hole 11 are resiliently held in close contact with the outer periphery of the coating 96 of each wire 95 in the circumferential direction to provide sealing between each wire 95 and the rubber plug 10 in a liquid-tight manner. Further, each outer peripheral lip 18 of the rubber plug 10 is held resiliently in close contact with the inner peripheral surface of the accommodation recess 57 in the circumferential direction to provide sealing between the rubber plug 10 and the connector housing 50 in a liquid-tight manner.

Each large-diameter sealing hole 11A receives a deformation force in a diameter expansion direction by having the wire 95A for high current inserted therein and is affected by a cumulative deformation force in the diameter expansion direction of the respective small-diameter sealing holes 11B laterally arranged side by side. However, the influence of the cumulative deformation force of the respective small-diameter sealing holes 11B is effectively reduced by the recesses 17 provided on the both front and rear surfaces of the rubber plug body 12.

Each large-diameter sealing hole 11A receives a deformation force in a diameter reduction direction by each corner part 13 being held in close contact with the inner periphery of the accommodation recess 57 to receive a resilience force. The resilience force from the inner periphery of the accommodation recess 57 is reduced by the lightening portions 21 on the base ends of the outer peripheral lips 18 on the outer peripheries of the respective corner parts 13 of the rubber plug body 12. Each lightening portion 21 includes the deepest part 21A recessed deeply from the vertex 18D on each corner part 13 toward the center of the large-diameter sealing hole 11A. Thus, the resilient force on the vertex 18D on each corner part 13 is reduced significantly. Each large-diameter sealing hole 11A is maintained in a predetermined shape without being deformed excessively. As a result, a state where each wire 95 is inserted properly in the large-diameter sealing hole 11A is kept satisfactorily.

A positional deviation of each large-diameter sealing hole 11A also is restricted by the lightening portions 21 on each corner part 13. Thus, a state where each large terminal fitting 90A is inserted smoothly into the large-diameter sealing hole 11A while being guided by the gentle slope parts 19B is ensured. Therefore, the inner peripheral lips 19 of each large-diameter sealing hole 11A are not damaged when the large terminal fitting 90A passes.

As described above, according to this embodiment, a resilient force acting on each corner part 13 of the rubber plug body 12 is reduced by the lightening portions 21. Thus, each large-diameter sealing hole 11A need not be deformed a large amount. Thus, the inner surface of each large-diameter sealing hole 11A is not damaged by the terminal fitting 90 and the wire 95 is not inserted in a bent state into the large-diameter sealing hole 11A.

The close contact of the outer peripheral lips 18 is not particularly reduced by providing the lightening portions 21 in the base end parts of the outer peripheral lips 18, and a recessed amount of the lightening portions 21 can be adjusted according to an inward projecting amount of the inner peripheral lips 19 by providing the lightening portions 21 in parts facing the inner peripheral lips 19 of the sealing holes 11 on the sides of the corner parts 13. Thus, good sealability of each corner part 13 of the rubber plug body 12 can be ensured.

Other embodiments are briefly described below.

Only one outer peripheral lip may be provided on the rubber plug body. Also, only one inner peripheral lip may be provided in the rubber plug body.

The large-diameter sealing hole only has to be provided to correspond to at least one corner part out of the four corner parts and may not necessarily be provided to correspond to each of the four corner parts.

The rubber plug body may have a polygonal shape other than a rectangular shape when viewed from front if the rubber plug body has corner parts.

The sealing holes may be composed of a single type of sealing holes having the same hole diameter or three or more types of sealing holes having different hole diameters.

LIST OF REFERENCE SIGNS

10 . . . rubber plug
11 . . . sealing hole
11A . . . large-diameter sealing hole
12 . . . rubber plug body
18 . . . outer peripheral lip
18D . . . vertex part
19 . . . inner peripheral lip
21 . . . lightening portion
21A . . . deepest part
22 . . . adjacent region
50 . . . connector housing
57 . . . accommodation recess
90 . . . terminal fitting

What is claimed is:

1. A rubber plug, comprising a mat-like rubber plug body including sealing holes, a wire with terminal being inserted into each sealing hole in a liquid-tight manner, wherein:

a corner part protruding outward on the rubber plug body includes, an outer peripheral lip provided circumferentially on an outer periphery of the rubber plug body and an inner peripheral lip provided circumferentially on an inner periphery of each sealing hole; and a lightening portion recessed more inwardly than regions adjacent in a circumferential direction is provided for the outer peripheral lip in a base end part of the outer peripheral lip and in a part facing the inner peripheral lip of the sealing hole near the corner part on the corner part side on the outer periphery of the rubber plug body.

2. The rubber plug of claim 1, wherein the sealing holes include a large diameter sealing hole near the corner part and small-diameter sealing holes spaced from the corner part.

3. The rubber plug of claim 2, wherein:

the rubber plug body has a substantially rectangular shape with four of the corner parts in a front view; and the lightening portion includes a deepest part most deeply recessed from a vertex of the corner part toward a center of the sealing hole near the corner part.

4. The rubber plug of claim 1, wherein:

the rubber plug body has a substantially rectangular shape with four of the corner parts in a front view; and the lightening portion includes a deepest part most deeply recessed from a vertex of the corner part toward a center of the sealing hole near the corner part.

5. A waterproof connector, comprising a connector housing having an accommodation recess for accommodating the rubber plug of claim 1, wherein:

the outer peripheral lip is held resiliently in close contact with an inner periphery of the accommodation recess.

* * * * *